US005683556A

United States Patent [19]

Nomura et al.

[11] Patent Number: 5,683,556

[45] Date of Patent: Nov. 4, 1997

[54] DISCHARGING AND DUST REMOVING METHOD AND DISCHARGING AND DUST REMOVING APPARATUS

[75] Inventors: Nobuo Nomura, Kanagawa; Fumiyoshi Shimizu, Tokyo, both of Japan

[73] Assignee: Kasuga Denki, Incorporated, Tokyo, Japan

[21] Appl. No.: 534,889

[22] Filed: Sep. 27, 1995

[30] Foreign Application Priority Data

Dec. 15, 1994 [JP] Japan ..... 6-332872

[51] Int. Cl.[6] ..... H05F 3/00

[52] U.S. Cl. ..... 204/164; 361/213; 361/214

[58] Field of Search ..... 204/164; 361/213, 361/214

[56] References Cited

U.S. PATENT DOCUMENTS

| | | | |
|---|---|---|---|
| 3,475,652 | 10/1969 | Levy | 361/213 |
| 3,729,648 | 4/1973 | Kerr | 361/213 |
| 4,027,201 | 5/1977 | Bacon et al. | 361/213 |
| 4,486,808 | 12/1984 | Cardone | 361/213 |
| 5,432,454 | 7/1995 | Durkin | 361/213 |

FOREIGN PATENT DOCUMENTS 63-301495 12/1988 Japan .

*Primary Examiner*—Kathryn L. Gorgos
*Assistant Examiner*—Kishor Mayekar
*Attorney, Agent, or Firm*—Sughrue, Mion, Zinn, Macpeak and Seas

[57] ABSTRACT

The invention provides a discharging method by which charges can be removed readily, uniformly and efficiently from a surface of a working object even where the surface has a complicated charge pattern of a large number of small positive and negative charged portions present closely to each other at random in a mixed condition. A working object is passed between a positive and negative ion producing discharging electrode and an ion attracting electrode opposed to the positive and negative ion producing discharging electrode and having a face extending in a travelling direction of the working object and a perpendicular direction. During such passage, high positive and negative voltages are applied alternately to the positive and negative ion producing discharging electrode to alternately produce positive and negative ions. Simultaneously, a high ac voltage is applied to the ion attracting electrode to induce positive and negative potentials in the working object so as to attract the positive and negative ions produced by the positive and negative ion producing discharging electrode by the induced potentials of the working object.

11 Claims, 21 Drawing Sheets

DISCHARGING AND DUST REMOVING METHOD AND DISCHARGING AND DUST REMOVING APPARATUS

BACKGROUND OF THE INVENTION

1. Field of the Invention

This invention relates to a discharging and dust removing method and a discharging and dust removing apparatus for removing electric charge and dust from a working object in the form of an electric insulating member such as a plastic film, a plastic plate, a plastic card or a paper sheet or web while it is travelling.

2. Description of the Related Art

Various methods of discharging (removing electrostatic charge from) such a processing or working object as mentioned above are already known. One method of discharging a plastic film is disclosed in Japanese Patent Laid-Open Application No. Showa 63-301495. In order to allow discharging of a working object which is travelling at a high speed and eliminate reverse charging by over-discharging, the method involves two stages of discharging operations including high frequency discharging and de discharging and also involves feedback control of the dc discharger. In particular, a travelling object in a somewhat charged condition is first discharged by high frequency corona discharging by a high frequency discharger. Then, a potential and a polarity of residual electrostatic charge of the travelling object after completion of such high speed discharging processing are detected by means of a potential detector, and the dc discharger is automatically controlled in response to the thus detected potential and polarity so that it may cause dc corona discharging, which has the opposite polarity to that of the residual charge and is to cancel the residual potential, to occur from the dc discharger to remove the residual charge by neutralization.

However, with the discharging method, since an expensive high frequency discharger must be used and a potential and a polarity of residual charge of a travelling object after high frequency discharging processing must be detected to automatically control the magnitude and the polarity of the voltage to be applied to the dc discharger by feedback control, the control system is complicated and a high cost is required for the entire discharging apparatus.

When a plastic film is fed under the guidance of a roller in a process of manufacture and working of the plastic film, since the plastic film repeats its friction with and exfoliation from the roller, charging (frictional charging) and electrostatic discharging (exfoliation discharging) are repeated. Further, where the plastic film is a film to undergo printing, the surface of the film is treated by corona discharging in order to change the quality of the same to assure a high printing performance. As a result of such frictional charging and exfoliation discharging as well as corona discharging processing, an invisible charge pattern wherein a very large number of small positive and negative charged portions having very complicated shapes are formed closely to each other at random in a mixed condition is formed on each of the opposite front and back faces of the plastic film in accordance with manners of charging and manners of discharging. FIG. 8 illustrates an example of such invisible charge pattern which was made visible by scattering toner powder (black fine particles) of the negative polarity, which is normally used with a copying machine or the like, on a surface of a plastic film immediately after exfoliation from a roller so as to cause the toner powder to directly stick to the surface of the plastic film electrostatically and then transferring the sticking toner powder image, using a copying machine, to a paper sheet to obtain the figure shown in FIG. 8. Black portions to which toner powder stuck were positively charged portions while bright portions to which no toner powder stuck were negatively charged portions, and the intensity of the black color represents the magnitude of the electrostatic potential there.

Even if it is tried to measure, using a potential measuring instrument, a charge potential of a plastic film which exhibits such a charge pattern in which small areas of positive and negative potentials are present in a complicated mixed condition, it is only possible to measure an average polarity and potential over a wide area, which depends upon the performance of the potential measuring instrument. In particular, since a small positively charged portion and a small negatively charged portion positioned in the proximity of each other exhibit a closed electric field and exhibit an electrostatically neutralized condition with each other on the surface of the film, such small portions have little influence on the measurement of the potential measuring instrument, and it cannot be avoided that the potential measuring instrument provides only a macroscopic result of measurement over a wide area.

Further, when a face of a film is discharged using a conventional discharger, ions produced by the discharger flow by a greater amount as the charge potential of the face of the film increases, but where the charge potential is low, such ions flow little. Accordingly, when small positive and negative charged portions exhibit an electrostatically neutral condition, no ions from the discharger will flow there, resulting in failure of discharging there.

However, according to conventional discharging methods including the discharging method disclosed in Japanese Patent Laid-Open Application No. Showa 63-301495 mentioned hereinabove, a polarity and a potential of charge are estimated from a result of such macroscopic measurement as described above, and charging conditions are decided uniformly in accordance with the thus estimated polarity and potential of charge (a voltage to be applied to a discharging electrode and so forth are set), and then positive and negative ions from a discharger positioned in a spaced relationship from a film are merely irradiated one-sidedly toward one face of the film. However, the opposite face of the film is left as an open face free from a grounding member or the like. Consequently, if the face of the film has such a charge pattern as described above thereon, then it has a large number of portions which have not been discharged microscopically. Consequently, even if a discharging step is performed repetitively, small uneven not-discharged portions remain to the last, resulting in deterioration of the quality of a product in which the plastic film is used as a material. For example, in the case of a product in the form of a film such as a magnetic tape wherein a magnetic material, a coating agent and so forth are to be applied to the surface of a plastic film employed as a base, it is impossible to apply such magnetic material or coating agent uniformly to the surface of the plastic film due to a discharge pattern. Or, in order to eliminate uneven not-discharged portions, a very high voltage must be used. In this instance, a discharging action of one of the positive and negative polarities is liable to become excessively strong, which may give rise to reverse charging (charging of the opposite polarity). Thus, an additional discharging step is required to remove the charge of the opposite polarity, which deteriorates the efficiency.

Such situations are not unique to those products wherein a plastic material is employed, but similarly apply to those products wherein a glass plate is employed (for example, a glass base plate for a liquid crystal display or the like).

Further, in order to remove dust or the like sticking to a face of a film in addition to discharging, also it is a common practice to jet air or irradiate an ultrasonic wave to the face of the film. However, where the film has such a complicated charge pattern as described hereinabove formed on the face thereof, dust or the like which sticks to the face of the film by a Coulomb force by charge cannot be removed uniformly.

SUMMARY OF THE INVENTION

It is an object of the present invention to provide a discharging and dust removing method by which charge and dust can be removed readily and uniformly with a high efficiency from a surface of a working object even where the surface has a complicated charge pattern wherein a large number of small positive and negative charged portions are present closely to each other at random in a mixed condition.

It is another object of the present invention to provide a discharging and dust removing apparatus by which such discharging and dust removing method as described just above can be performed economically.

It is a further object of the present invention to provide a discharging and dust removing method and a discharging and dust removing apparatus by which reverse charging by over-discharging can be minimized.

In order to attain the objects described above, according to an aspect of the present invention, there is provided a discharging method wherein positive and negative ions are irradiated upon a travelling working object to discharge the working object, comprising the steps of passing the working object between a positive and negative ion producing discharging electrode apparatus and an ion attracting electrode apparatus disposed in an opposing relationship to the positive and negative ion producing discharging electrode apparatus and having a face which extends in a travelling direction of the working object and a perpendicular direction, applying, while the working object passes between the positive and negative ion producing discharging electrode apparatus and the ion attracting electrode apparatus, high positive and negative voltages alternately to the positive and negative ion producing discharging electrode apparatus to alternately produce positive and negative ions, and simultaneously applying a high ac voltage to the ion attracting electrode apparatus to induce positive and negative potentials in the working object so as to attract the positive and negative ions produced by the positive and negative ion producing discharging electrode apparatus by the induced potentials of the working object.

According to another aspect of the present invention, there is provided a discharging apparatus, comprising an ion attracting electrode apparatus having a face extending in a travelling direction of a travelling working object and a perpendicular direction, a positive and negative ion producing discharging electrode apparatus opposed to the ion attracting electrode apparatus with a distance left therebetween sufficient to allow the working object to pass therebetween, and a power source apparatus for applying high positive and negative voltages alternately to the positive and negative ion producing discharging electrode apparatus to produce positive and negative ions alternately and simultaneously applying to the ion attracting electrode apparatus a high ac voltage synchronized with but having opposite polarities to those of the high voltages applied to the positive and negative ion producing discharging electrode apparatus.

Preferably, positive and negative ions are produced from a plurality of positive and negative ion producing discharging electrodes of the positive and negative ion producing discharging electrode apparatus disposed in parallel in the travelling direction of the working object and are irradiated upon the working object so as to repetitively perform discharging of the working object. In this instance, the ion attracting electrode apparatus may include a single ion attracting electrode provided commonly to all of the positive and negative ion producing discharging electrodes or a plurality of ion attracting electrodes individually provided corresponding to the positive and negative ion producing discharging electrodes.

In the discharging method and apparatus, when the positive and negative ion producing discharging electrode apparatus produces positive and negative ions alternately or at a time, a high ac voltage is applied to the ion attracting electrode apparatus opposed to the positive and negative ion producing discharging electrode apparatus. Consequently, in the working object which travels between the positive and negative ion producing discharging electrode apparatus and the ion attracting electrode apparatus, positive and negative potentials are induced alternately by electrostatic capacitors formed between the working object and the ion attracting electrode apparatus. The positive and negative ions produced by the positive and negative ion producing discharging electrode apparatus are not attracted to the working object when the polarities thereof are the same as those of the potentials induced in the working object, but when the polarities are opposite to each other, the positive and negative ions are attracted to the working object by a Coulomb force. Since the polarities of the potentials induced in the working object vary in accordance with the period of the high ac voltage applied to the ion attracting electrode apparatus, the ions from the positive and negative ion producing discharging electrode apparatus are, whether they are positive ions or negative ions, acted upon directly by a Coulomb force from the working object and positively attracted to and irradiated upon the surface of the working object. As a result, even if the surface of the working object has a microscopically neutral condition wherein a large number of small positive and negative charged portions are present at random in a mixed condition in such a manner as to exhibit a complicated charge pattern as seen in FIG. 8, since potentials which attract positive and negative ions are induced in the working object, the negative ions react with the positive charged portions of the working object while the positive ions react with the negative charged portions with certainty so that the positive and negative charged portions are discharged strongly and separately from each other. In this instance, since the ion attracting electrode apparatus has the face which extends in a travelling direction of the working object and the perpendicular direction, even if the working object travels, local unevenness little occurs with the ion attracting force of the working object. Further, since the voltage applied to the ion attracting electrode apparatus is a high ac voltage which exhibits a periodical variation between positive and negative values, such a situation that the ion attracting electrode apparatus attracts the working object itself to obstruct the travelling of the working object does not occur.

Since the voltages applied to the positive and negative ion producing discharging electrode apparatus and the ion attracting electrode apparatus exhibit varying polarities and the working object moves relative to the two electrode apparatus, when the charged face of the working object is viewed in the travelling direction, areas which are acted upon strongly by the discharging operation of positive ions and areas which are acted upon strongly by the discharging operation of negative ions appear alternately. Thus, where positive and negative ions from the positive and negative ion producing discharging electrode apparatus which includes a plurality of positive and negative ion producing discharging electrodes are positively irradiated upon the working object at different locations, then not only can a discharging efficiency be raised, but also the positive and negative discharging actions can be averaged in the travelling direction of the working object to reduce such discharge unevenness. Further, such discharge unevenness which appears macroscopically can be eliminated more effectively by constructing the positive and negative ion producing discharging electrode apparatus such that the discharging actions by the plurality of positive and negative ion producing discharging electrodes gradually decrease toward the travelling direction of the working object or by constructing, where the ion attracting electrode apparatus includes a plurality of ion attracting electrodes individually provided corresponding to the positive and negative ion producing discharging electrodes, the ion attracting electrode apparatus such that the voltages to be applied to the ion attracting electrodes gradually decrease toward the travelling direction of the working object. Such elimination of macroscopic discharge unevenness can be promoted by employing, as a next auxiliary step, weak dc discharging by a dc discharger and/or weak ac discharging by an ac discharger.

The ion attracting electrode apparatus may be in the form of a plate or a roller which rotates to guide the working object. Where a metal roller is employed, a dielectric layer is formed on the surface of the metal roller in order to produce an electrostatic capacitor between the metal roller and the working object and in order to prevent spark discharge. Preferably, one of the positive and negative ion producing discharging electrode apparatus and the ion attracting electrode apparatus is disposed for movement toward and away from the working object so that the distance between the positive and negative ion producing discharging electrode apparatus and the ion attracting electrode apparatus may be varied.

Where air is jetted to the working object while the working object continuously travels after it has been discharged in such a manner as described above, removal of dust from the working object can be performed uniformly. Such removal of dust is preferably performed by an air shower dust removing unit which includes an air jetting section for jetting air to the working object and an air sucking section for sucking the air jetted from the air jetting section.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 1:
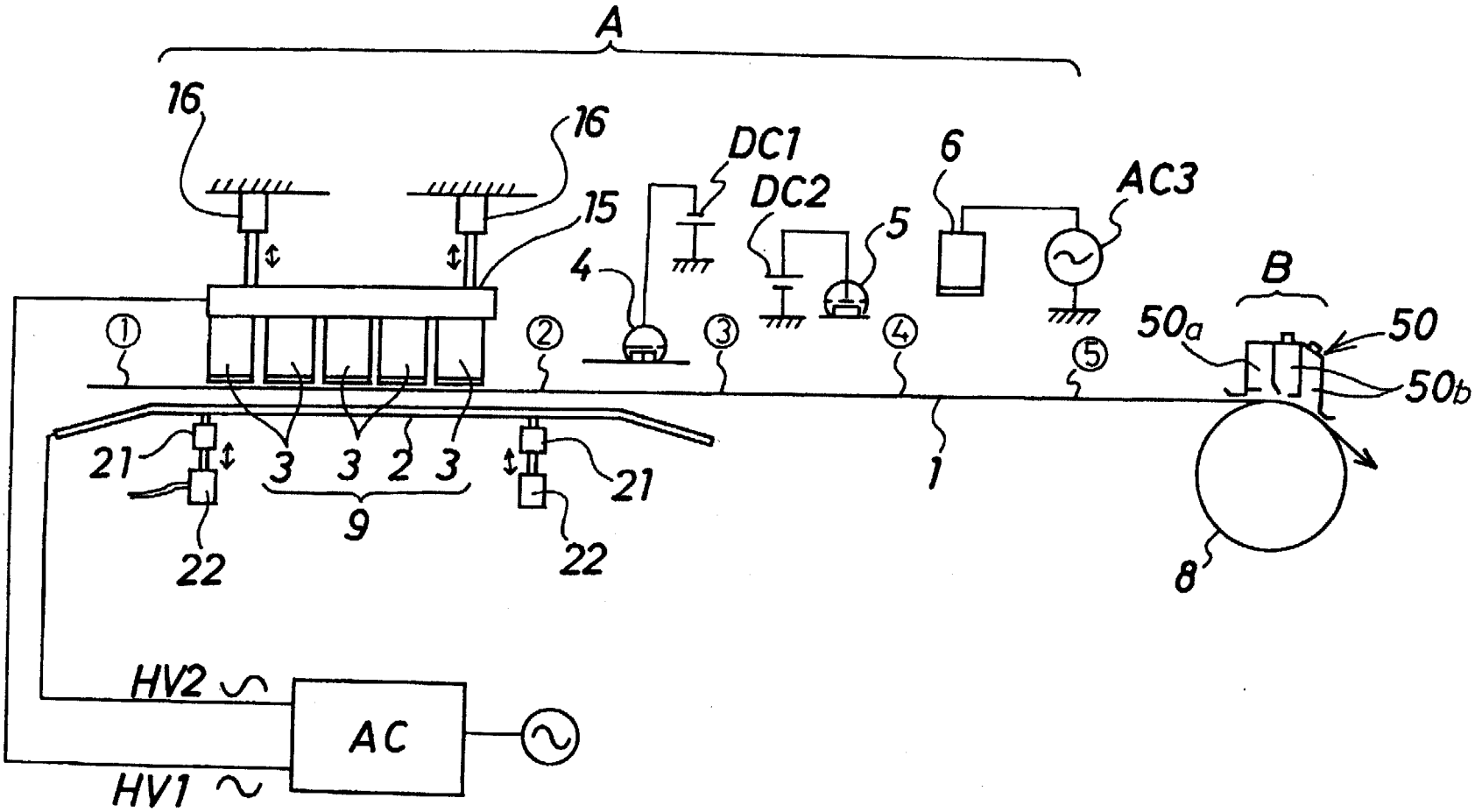
FIG. 1 is a schematic illustrative view showing an outline of an entire discharging and dust removing apparatus to which the present invention is applied.

Referring first to FIG. 1, there is shown a general construction of an entire discharging and dust removing apparatus to which the present invention is applied. A plastic film (hereinafter referred to merely as film) 1 which is an object of working is fed in the rightward direction in FIG. 1 under the guidance of a guide roller 8. During such rightward travel, the film 1 is first discharged at a discharging station A, and then dust is removed from the film 1 at a dust removing station B. In the discharging station A, a plurality of positive and negative ion producing discharging electrodes 3 are disposed in an opposing relationship to a common ion attracting electrode 2 to construct a discharging gate section 9. Thus, the film 1 is discharged at a plurality of stages between the positive and negative ion producing discharging electrodes 3 and the ion attracting electrode 2 in such a manner as hereinafter described while it passes the discharging gate section 9.

Figure 5:
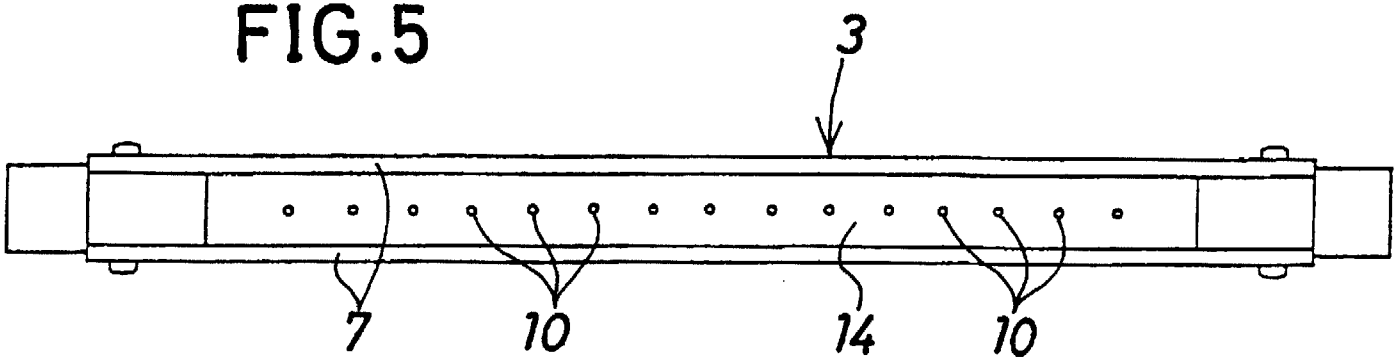
FIG. 5 is a bottom plan view showing an example of a positive and negative ion producing discharging electrode of the positive and negative ion producing discharging electrode apparatus.
Figure 6:
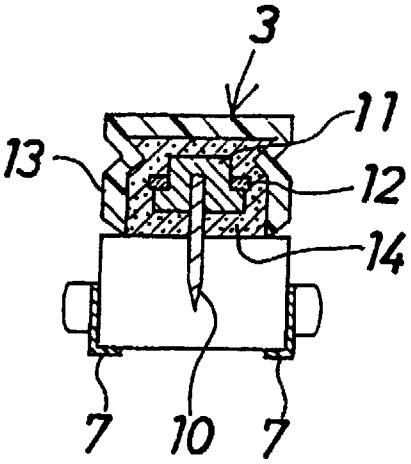
FIG. 6 is an enlarged cross sectional view of the positive and negative ion producing discharging electrode shown in FIG. 5.

Each of the discharging electrodes 3 extends in a widthwise direction of the film 1 and has a length greater than the widthwise dimension of the film 1. While discharging electrodes of various structures can be employed for the discharging electrodes 3, a discharging electrode which includes a large number of discharging needles is economically employed for the discharging electrodes 3. An exemplary one of existing discharging electrodes of the type just mentioned is shown in FIG. 5 (bottom plan view) and FIG. 6. Referring to FIGS. 5 and 6, the positive discharging electrode 3 shown includes a large number of discharging needles 10 individually planted separately from each other on a large number of cores 11 each formed from a ceramic dielectric member or a ceramic resistor member so as to establish capacitive couplings or resistive couplings which are separate from each other. In particular, the cores 11 are fitted one by one in a large number of holes of a printed circuit board 12, and the cores 11 and the printed circuit board 12 are embedded in an insulating molded member 14 in a resin casing 13 such that the discharging needles 10 are partially projected from the surface of the insulating molded member 14 in a spaced relationship from each other at fixed distances in a longitudinal direction of the resin casing 13 (in the widthwise direction of the film 1). Further, a pair of grounding electrode plates 7 are disposed in an opposing parallel relationship to each other on the opposite sides of the arrangement of the discharging needles 10. Thus, when a high voltage is applied to a conductive pattern of the printed circuit board 12, corona discharge occurs at a time between all of the discharging needles 10 and the grounding electrode plates 7 to produce ions. Consequently, each of the discharging electrodes 3 can be used also as a single independent discharger. The discharging electrodes 3 have a length greater than the width of the film 1.

In the apparatus shown in FIG. 1, a plurality of such discharging electrodes 3 are employed and arranged in parallel in a spaced relationship from each other in the travelling direction (longitudinal direction) of the film 1 and in a spaced relationship by a small distance from a face (upper face) of the film 1. Thus, a high ac voltage HV1 is applied from a high ac voltage power source AC to the discharging electrodes 3. The distance between the discharging electrodes 3 is adjusted in accordance with the travelling speed of the film 1. The discharging electrodes 3 are held on a common holder 15 and can be moved (adjusted in position) toward and away from the film 1 by a pair of linear motion actuators 16 such as air cylinders.

Meanwhile, the ion attracting electrode 2 is formed from a single plate such as a conductive metal plate having a flat face opposing commonly to all of the discharging electrodes 3 with regard to both of the travelling direction and the widthwise direction of the film 1, and is disposed such that it does not contact the film 1. Another high ac voltage HV2 having a phase opposite to that of the high ac voltage HV1 to be applied to the discharging electrodes 3 is applied to the ion attracting electrode E from the high ac voltage power source AC. Also the ion attracting electrode 2 is supported on a pair of linear motion actuators 22 such as air cylinders by way of respective insulators 21 such that it can be moved (adjusted in position) toward and away from the film 1.

Figure 2:
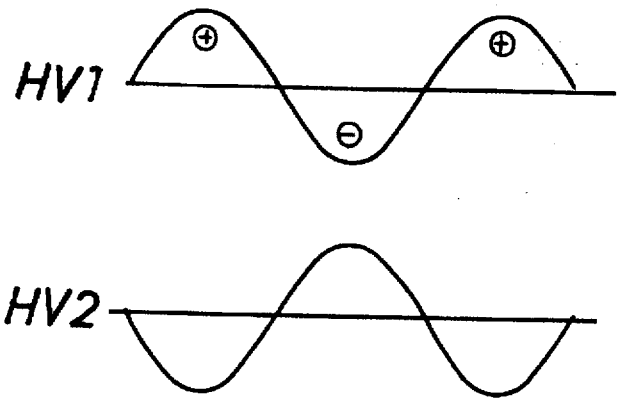
FIG. 2 is a waveform diagram illustrating a relationship in phase between ac voltages applied to a positive and negative ion producing discharging electrode apparatus and an ion attracting electrode apparatus shown in FIG. 1.
Figure 3:
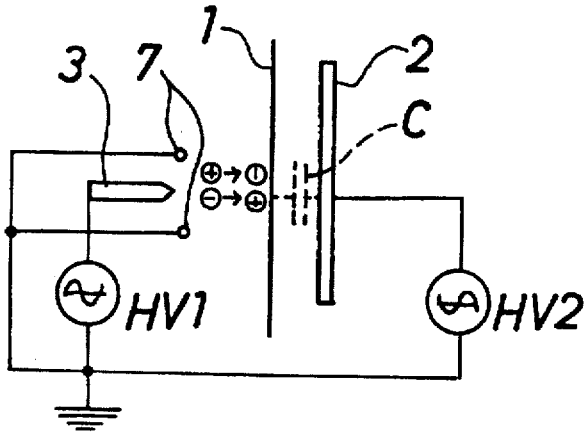
FIG. 3 is a circuit diagram of an equivalent circuit when an ac voltage is applied to the positive and negative ion producing discharging electrode apparatus.
Figure 4:
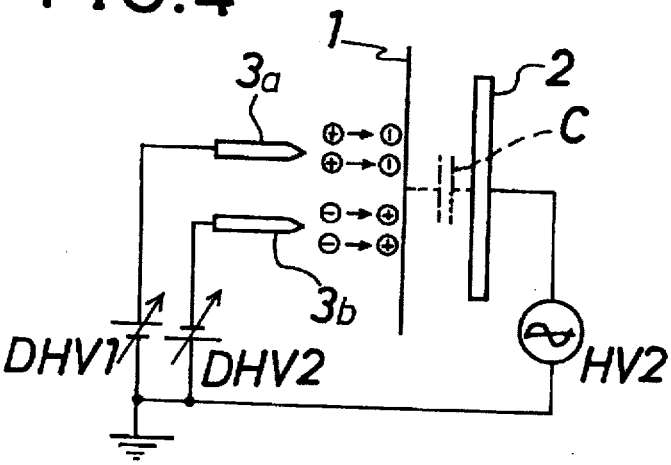
FIG. 4 is a circuit diagram of another equivalent circuit when positive and negative high voltages are applied to a positive ion production electrode and a negative ion production electrode of the positive and negative ion producing discharging electrode apparatus.

When the high ac voltages HV1 and HV2 of the opposite phases to each other as seen in FIG. 2 are applied to the positive and negative ion producing discharging electrodes 3 and the ion attracting electrode 2, respectively, positive and negative ions can be produced alternately by the positive and negative ion producing discharging electrodes 3 and attracted equally to the working object or film 1 itself. An equivalent circuit in this instance is shown in FIG. 3. Referring to FIG. 3, reference character 7 denotes a grounding electrode for the positive and negative ion producing discharging electrodes 3, and C denotes an electrostatic capacitor formed between the ion attracting electrode 2 and the film 1. Alternatively, however, positive ion producing electrodes 3*a* for producing positive ions and negative ion producing electrodes 3*b* for producing negative ions may be provided as (or in place of) the positive and negative ion producing discharging electrodes 3 such that high positive and negative dc voltages DHV1 and DHV2 are applied to the positive ion producing electrodes 3*a* and the negative ion producing electrodes 3*b*, respectively, to produce positive and negative ions at one time. An equivalent circuit in this instance is shown in FIG. 4.

Figure 8:
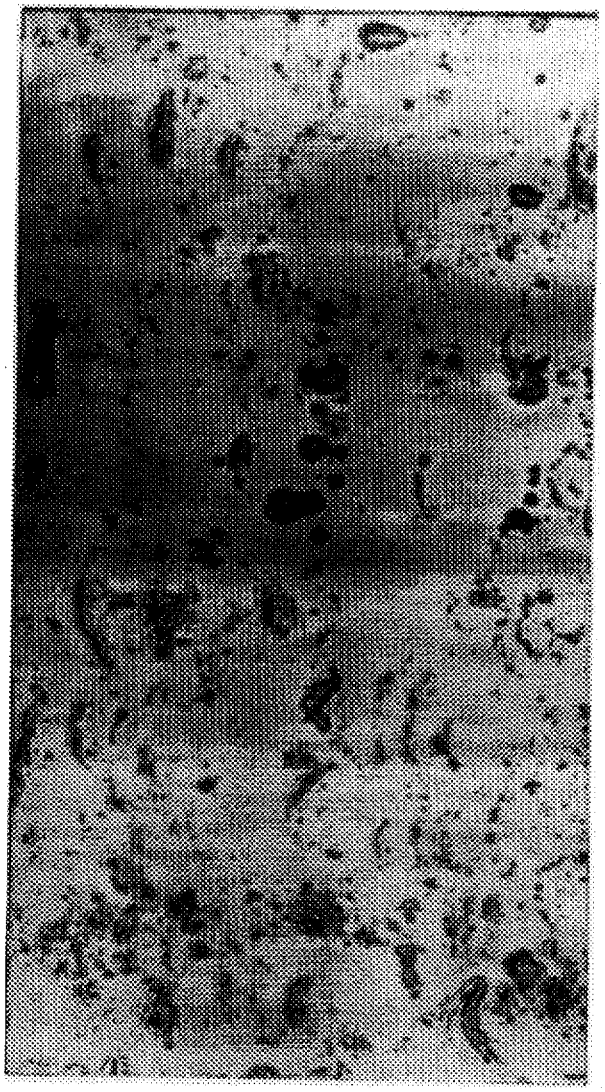
FIG. 8 is a photographic view showing a charge condition of a surface of a plastic film before discharging processing by means of the discharging and dust removing apparatus according to the present invention is performed.

Referring to FIGS. 1 to 3, when a positive high voltage is applied to the discharging electrodes 3 to produce positive ions, a negative high voltage is applied to the ion attracting electrode 2, whereupon a negative potential is induced in the face of the film 1 by the electrostatic capacitor C. On the other hand, when a negative high voltage is applied to the discharging electrodes 3, a positive high voltage is applied to the ion attracting electrode 2, whereupon a positive potential is induced in the face of the film 1. Consequently, positive and negative ions produced alternately by the discharging electrodes 3 are positively attracted to and irradiated upon the face of the film 1 each by a Coulomb force. As a result, even if the film 1, before it enters the discharging gate section 9 (position ① in FIG. 1), has a microscopically neutral condition wherein a large number of small positive and negative charged portions are present at random in a mixed condition in such a manner as to exhibit a complicated charge pattern as seen in FIG. 8, since, in the discharging gate section 9, negative ions react with the positive charged portions and positive ions react with the negative charged portions with certainty, the positive and negative charged portions can be discharged strongly and separately from each other. Besides, such action is performed repetitively by the plurality of discharging electrodes 3 juxtaposed in the travelling direction of the film 1. In this instance, since the ion attracting electrode 2 has a face which extends in the travelling direction and the widthwise direction of the film 1, local unevenness does not occur with the ion attracting force of the ion attracting electrode 2 and the ion attracting electrode 2 can attract positive and negative ions equally. Consequently, the ion attracting electrode 2 microscopically presents minimized discharge unevenness.

Figure 9:
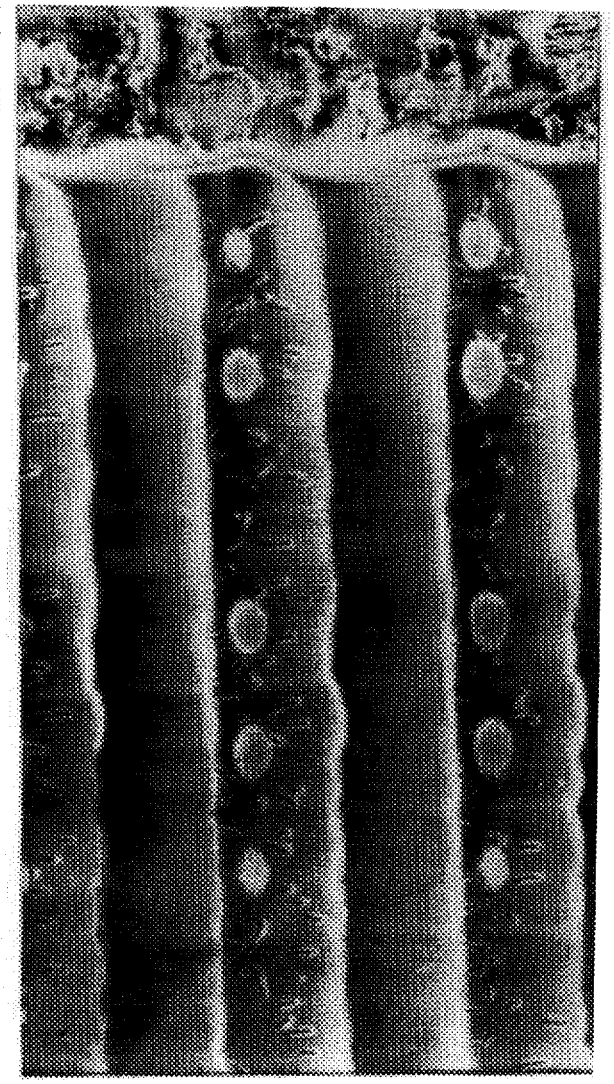
FIG. 9 is a similar view but showing a charge condition of the surface of the plastic film immediately after it undergoes discharging processing by means of the positive and negative ion producing discharging electrode apparatus and the ion attracting electrode apparatus.

FIG. 9 shows a condition wherein toner powder is scattered in a similar manner as in the case of FIG. 8 on the face of the film 1 immediately after it passes the discharging gate section 9 (at the position ② in FIG. 1). An area N adjacent one side edge of the face of the film 1 shown in FIG. 9 is a non-discharged area which has been masked so as not to undergo discharging processing, and the travelling direction of the film 1 is indicated by an arrow mark in FIG. 9. As can be seen from FIG. 9, the area of the face of the film 1 which has been discharged by the discharging gate section 9 does not exhibit such a complicated charge pattern as is exhibited on the non-discharged area N, but instead exhibits a plurality of thin white and black lateral stripes appearing alternately like waves in the travelling direction of the film 1 such that they extend in the widthwise direction of the film 1. This is because, due to the fact that the polarities of the voltages to be applied to the discharging electrodes 3 and the ion attracting electrode 2 are opposite to each other between the positive and the negative and the film 1 moves relative to those electrodes, when the charged face of the film 1 is viewed in the travelling direction, areas which are acted upon strongly by discharging operation of positive ions and areas which are acted upon strongly by discharging operation of negative ions appear alternately. Those uneven discharged areas which appear macroscopically in this manner can be averaged and thus minimized by means of a plurality of discharging electrodes 3 juxtaposed in parallel in the travelling direction of the film 1 such that positive and negative ions from them may be irradiated positively at different locations upon the face of the film 1.

Further, the amounts of positive and negative ions to be produced by the positive and negative ion producing discharging electrodes 3 vary in accordance with the frequency of the high ac voltage HV1 to be applied to the positive and negative ion producing discharging electrodes 3. Therefore, where the frequency is approximately equal to or around a frequency of a commercial ac power supply (50 Hz or 60 Hz in Japan), the period of the variation of the amount of ions to be produced is so long that, if the travelling speed of the film 1 is low, the film 1 is discharged unevenly. Thus, the frequency of the high ac voltage HV2 to be applied to the ion attracting electrode 2 is set higher than the frequency of the high ac voltage HV1 to be applied to the discharging electrodes 3 so that such discharge unevenness caused by the variation of ions to be produced with respect to time can be reduced.

Referring back to FIG. 1, in order to perform auxiliary discharging after such discharging by the discharging gate section 9 as described above, the discharging and dust removing apparatus further includes a negative ion producing dc discharger 4, a positive ion producing dc discharger 5 and an ac discharger 6 arranged in this order subsequently to the discharging gate section 9 in the travelling direction of the film 1. A high negative dc voltage is applied from a high dc voltage power source DC1 to the negative ion producing dc discharger 4, a high positive dc voltage is applied from another high dc voltage power source DC2 to the positive ion producing dc discharger 5, and a high ac voltage is applied from a high ac voltage power source AC3 to the ac discharger 6. Such an ac discharger as shown in FIGS. 5 and 6 may be used for the ac discharger 6. Meanwhile, a known dc discharger which employs a large number of discharging needles can be employed for the dc dischargers 4 and 5, and no special discharger need be employed.

The dc dischargers 4 and 5 and the ac discharger 6 are disposed such that the distances thereof to the film 1 are generally set greater than that of the discharging electrodes 3 of the discharging gate section 9 in order to make the discharging capacity to the film 1 lower than that of the discharging electrodes 3. Also, the distances thereof to the film 1 increase stepwise in the travelling direction of the film 1 in order to gradually decrease the discharging force to act upon the film 1.

Figure 10:
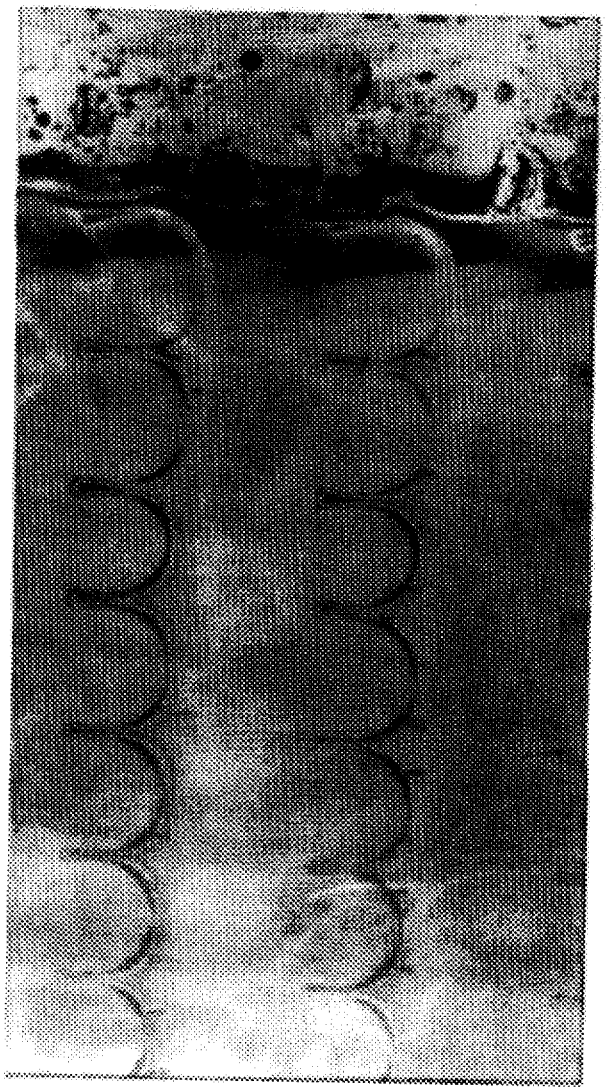
FIG. 10 is a similar view but showing a charge condition of the surface of the plastic film after discharging processing by means of a dc discharger, which produces negative ions, after the discharging processing of FIG. 9.

The film 1 which has been discharged in such a manner as described above by the discharging gate section 9 subsequently undergoes irradiation of negative ions from the negative ion producing dc discharger 4 so that, from among the positive and negative charged portions of the film 1 which appear alternately like waves as seen in FIG. 9, principally the positive charged portions are discharged. FIG. 10 shows a condition wherein toner powder is scattered in a similar manner as described hereinabove on the face of the film 1 after it has undergone the discharging processing just described (at the position ③ in FIG. 1). In FIG. 10, the film 1 exhibits no such wave-like charged portions as appear in FIG. 9, but U-shaped thin charged portions remain around the portions corresponding to the discharging needles of the dc discharger 4 and successively connect to each other in the widthwise direction of the film 1 to form a light continuous pattern. In the non-discharged area N which has been masked so as not to undergo the discharging processing, the complicated charge pattern still remains.

Figure 11:
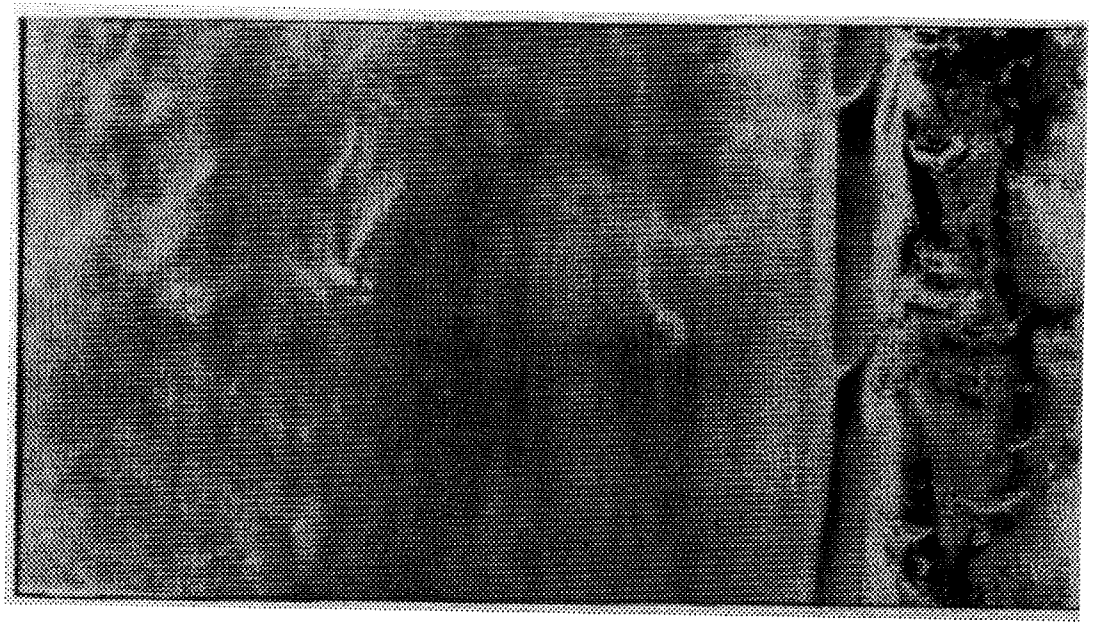
FIG. 11 is a similar view but showing a charge condition of the surface of the plastic film after further discharging processing by means of a dc discharger, which produces positive ions, after the discharging processing of FIG. 10.

Thereafter, the film 1 undergoes discharging processing with positive ions from the positive ion producing dc discharger 5. FIG. 11 shows a condition wherein toner powder is scattered on the face of the film 1 after it has undergone the discharging processing with positive ions (at the position ④ in FIG. 1). In FIG. 11, only a little thin white-black thick-thin uneven pattern remains on the face of FIG. 1. In the non-discharged area N, the complicated charge pattern still remains.

Figure 12:
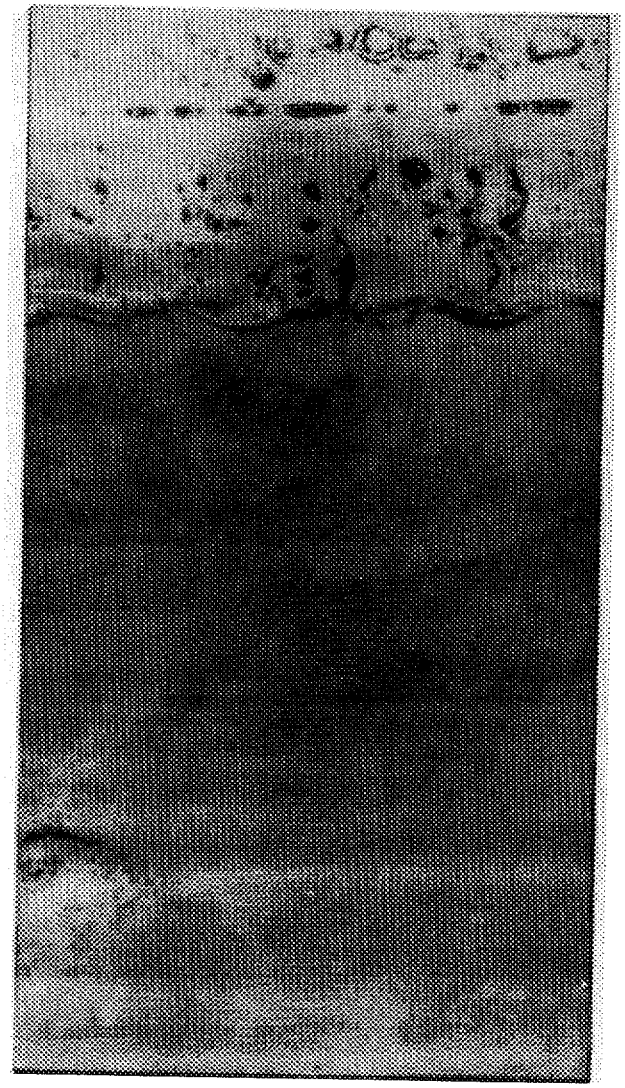
FIG. 12 is a similar view but showing a charge condition of the surface of the plastic film after further discharging processing by means of an ac discharger after the discharging processing of FIG. 11.

Finally, the film 1 undergoes weak discharging processing with positive and negative ions from the ac discharger 6. FIG. 12 shows a condition wherein toner powder is scattered on the face of the film 1 after it has undergone the discharging processing with positive and negative ions (at the position ⑤ in FIG. 1). In FIG. 12, no white-black thick-thin uneven pattern can be seen on the face of the film 1. In the meantime, the complicated charge pattern remains to the last in the non-discharged area N.

Referring back to FIG. 1, the film 1 which has been discharged in the discharging station A in such a manner as described above is subsequently transported to the dust removing station B. The dust removing station B includes an air shower dust removing unit 50 located above the guide roller 8. The air shower dust removing unit 50 includes a casing 51 in which an air jetting section 50*a* and a pair of air sucking sections 50*b* are defined by a pair of partitions. Air jetted from the air jetting section 50*a* hits upon and is reflected from the film 1 on the guide roller 8 and is then sucked into the two air sucking sections 50*b*. Consequently, dust or some other foreign particles sticking to the film 1 are compulsorily removed from the face of the film 1 and collected by the air shower dust removing unit 50. In this instance, dust or the like is removed thoroughly from the film 1 since it has been discharged thoroughly to such a degree that it exhibits no charge pattern.

Figure 7:
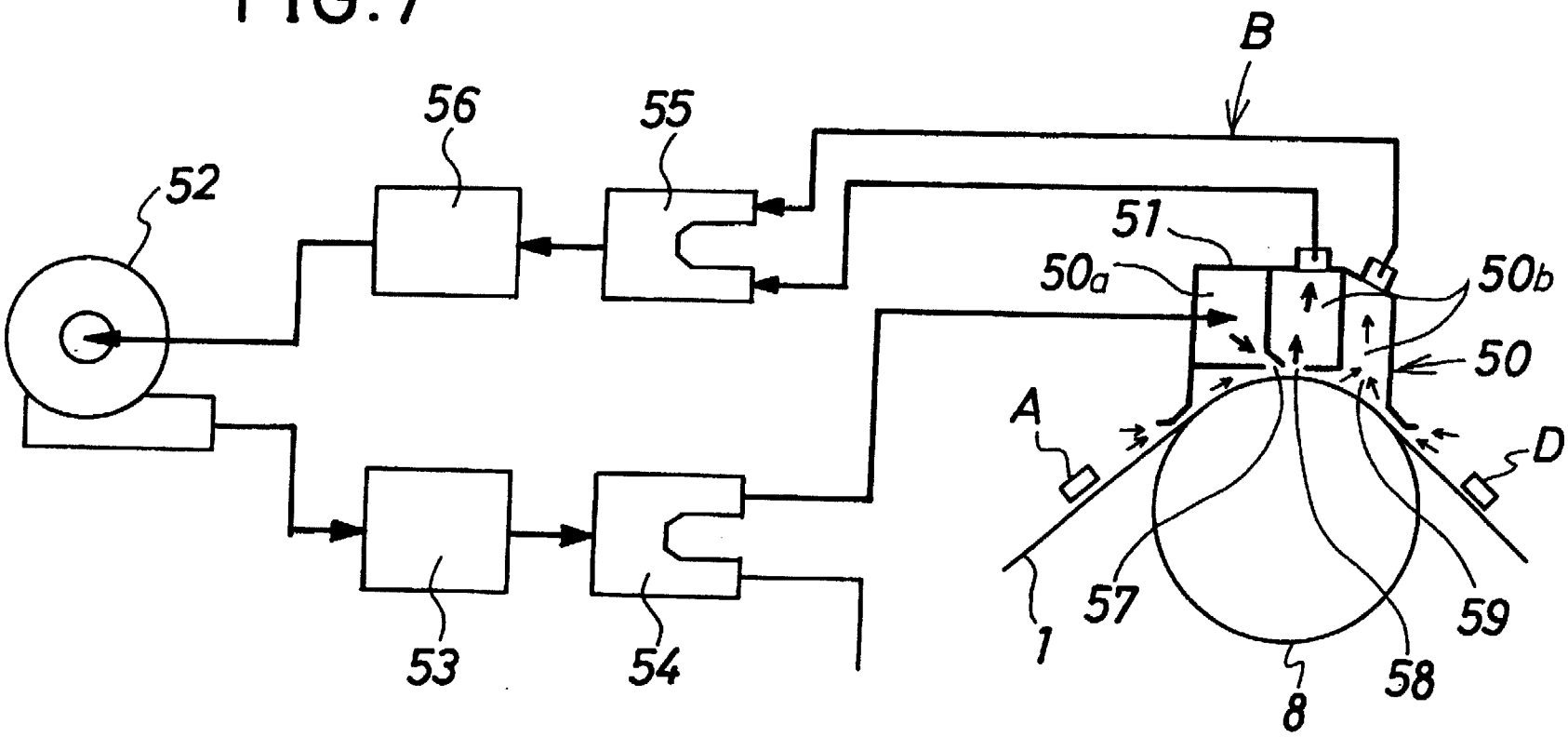
FIG. 7 is a schematic diagrammatic view showing a construction of an example of a dust removing station.

The dust removing station B is particularly shown in FIG. 7. Referring to FIG. 7, air from a blower 52 is forwarded into the air jetting section 50*a* of the air shower dust removing unit 50 by way of a forwarding side filter 53 and a forwarding side damper 54, and air sucked into the air sucking sections 50*b* is circulated back into the blower 52 by way of a sucking side damper 55 and a sucking side filter 56 by a sucking action of the blower 52. A nozzle 57 is provided for the air jetting section 50*a* such that it jets air obliquely toward the film 1 which travels on the surface of the guide roller 8. Meanwhile, a small sucking opening 58 is provided at an air sucking portion of one of the air sucking sections 50*b* which is located adjacent the air jetting section 50*a* while a large sucking opening 59 is provided at an air sucking portion of the other air sucking sections **50*b***.

Accordingly, air jetted from the nozzle 57 first hits upon and is reflected from the film 1 on the guide roller 8 and then is sucked into the two air sucking sections **50*b*. It is to be noted that discharging and dust removal may otherwise be performed at one time at the same location. In FIG. 7, reference character D denotes an auxiliary discharging station for discharging the film 1 after it is exfoliated from the guide roller 8**. Also the auxiliary discharging station D may have partially or entirely the same construction as the discharging station A described hereinabove.

Figure 13:
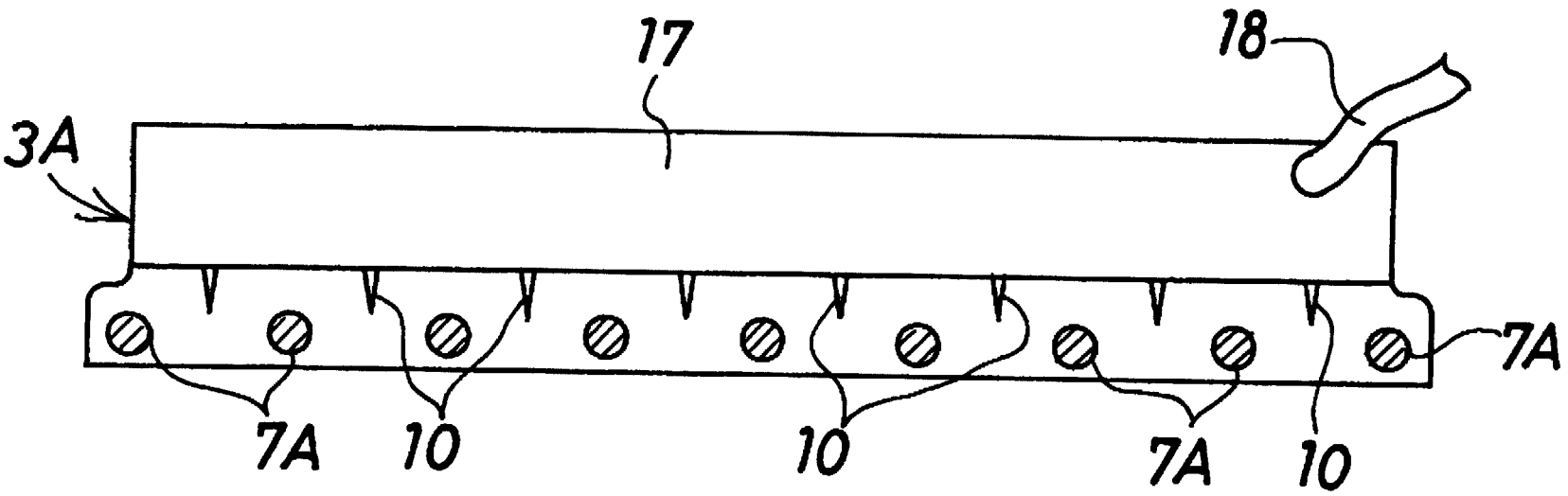
FIG. 13 is a partial cross sectional view of the positive and negative ion producing discharging electrode apparatus when it is formed so as to have a multiple ac electrode structure.
Figure 14:
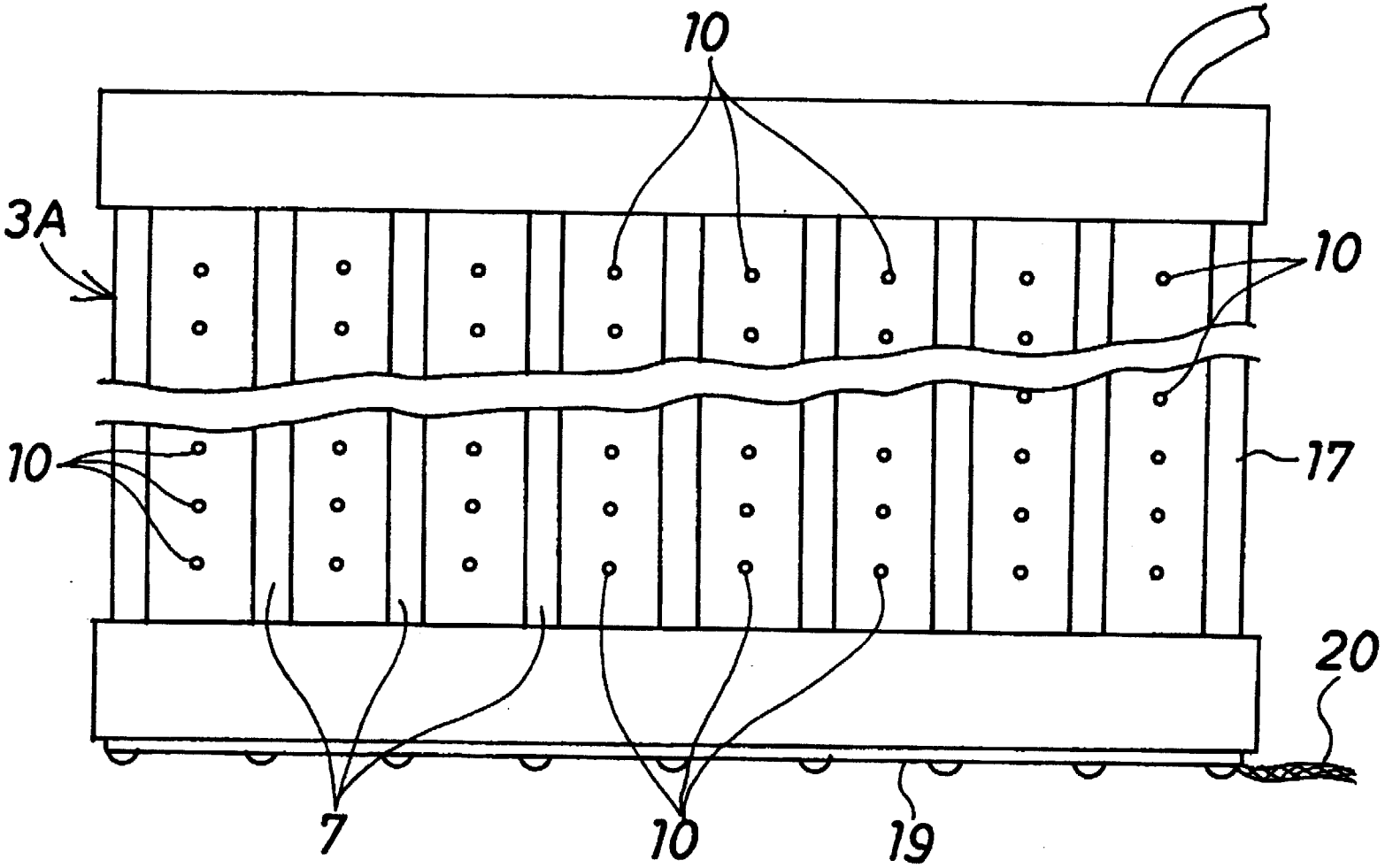
FIG. 14 is a bottom plan view of the positive and negative ion producing discharging electrode apparatus of FIG. 13.

In place of a plurality of such independent discharging electrodes as shown in FIGS. 5 and 6, such a multiple ac discharger 3A as shown in FIG. 13 and FIG. 14 (bottom plan view) may be employed. Referring to FIGS. 13 and 14, the multiple ac discharger 3A includes a plurality of rows of discharging needles 10 disposed in parallel in a spaced relationship from each other in the travelling direction of the film 1 on an insulating holder 17 in the form of a plate such that they project from the insulating holder 17, Each of the rows of the discharging needles 10 includes a large number of discharging needles 10 disposed in a predetermined spaced relationship from each other in the widthwise direction of the film 1. The multiple ac discharger 3A further includes a plurality of grounding electrode bars 7A mounted on the insulating holder 17 such that they extend parallel to each other and are positioned on the opposite sides of the individual rows of the discharging needles 10. A high tension cable 18 is led out from the insulating holder 17 so that a high ac voltage can be applied at once to all of the discharging needles 10 by way of the high tension cable 18. Further, all of the grounding electrode bars 7A can be grounded by way of a conductor plate 19 provided on the insulating holder 17 and a grounding cable 20 connected to the conductor plate 19. It is to be noted that, where the multiple ac discharger 3A shown in FIGS. 13 and 14 is employed, the ion attracting electrode 2 is formed such that it has a face opposed commonly to all of the rows of the discharging needles 10.

Figure 15:
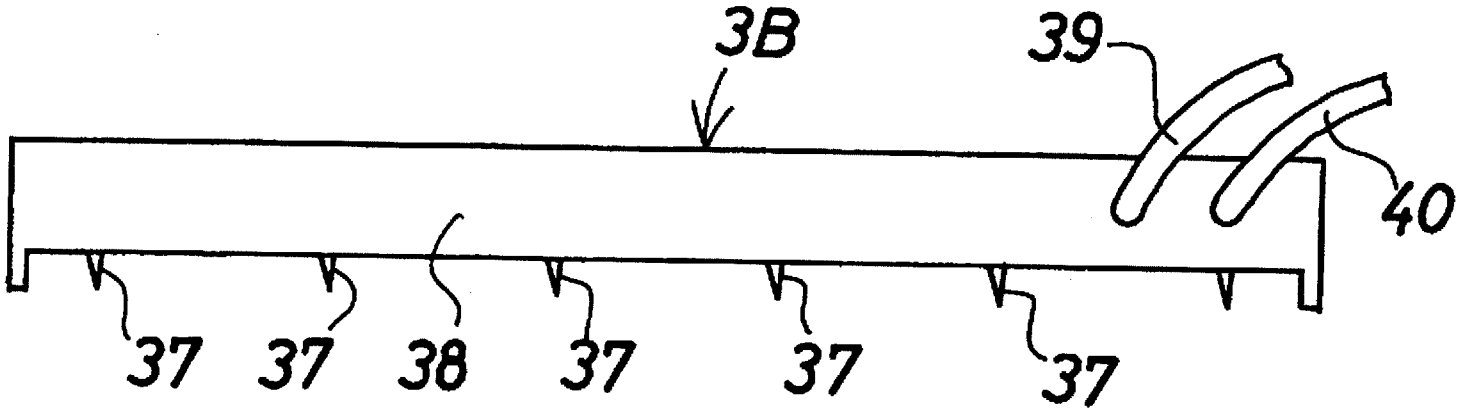
FIG. 15 is a partial cross sectional view of the positive and negative ion producing discharging electrode apparatus when it is formed so as to have another multiple dc electrode structure.
Figure 16:
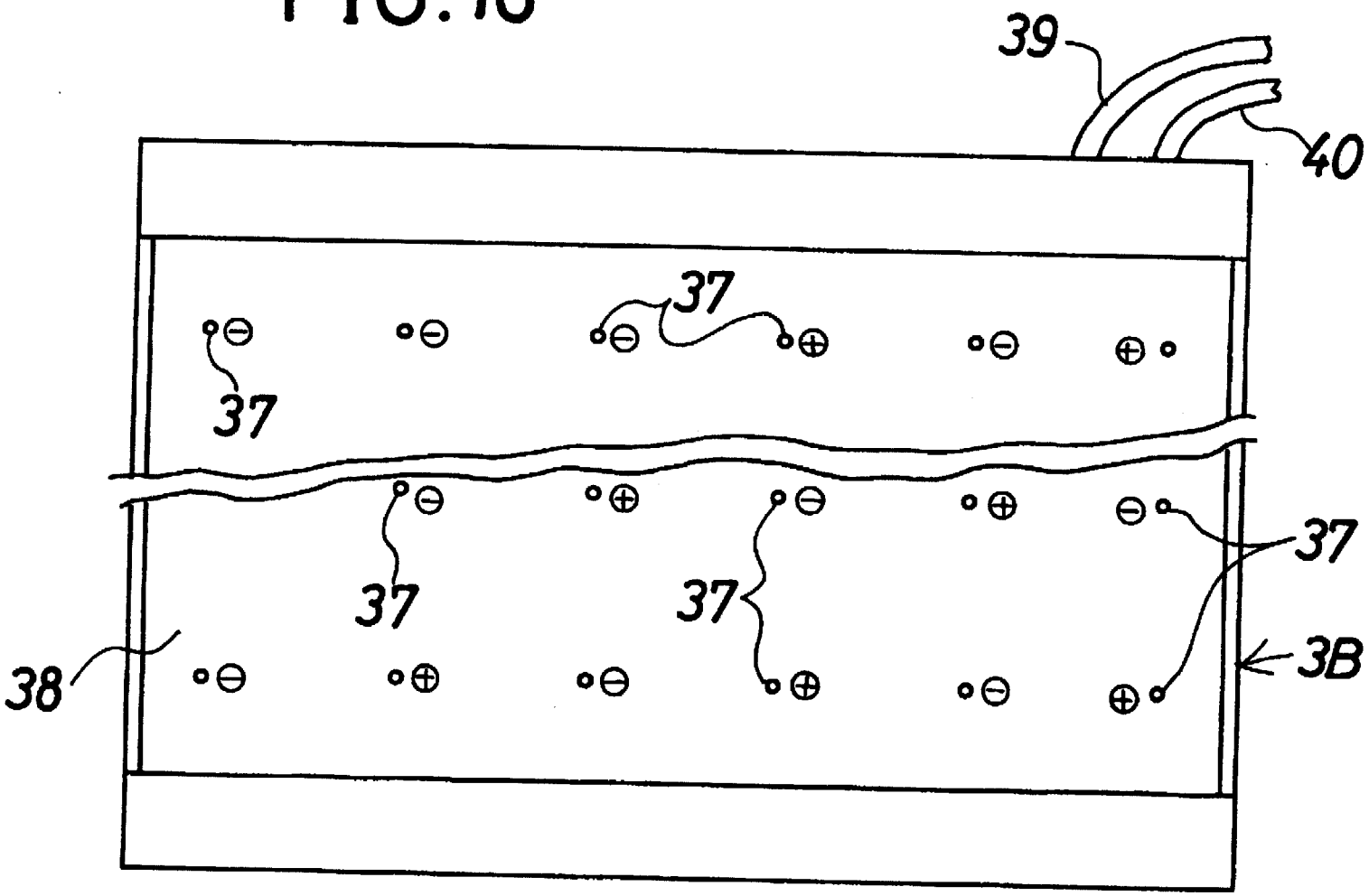
FIG. 16 is a bottom plan view of the positive and negative ion producing discharging electrode apparatus of FIG. 15.

FIGS. 15 and 16 show another multiple dc discharger 3B of the positive and negative ion simultaneous production type which can be employed in place of the discharging electrodes 3 of the discharging gate section 9. Referring to FIGS. 15 and 16, the multiple dc discharger 3B includes a large number of discharging needles 37 disposed in a plurality of parallel rows in a spaced relationship from each other in the travelling direction of the film 1 on an insulating holder 38 in the form of a plate and disposed, in each of the rows, in a predetermined spaced relationship from each other in the widthwise direction of the film 1. In this instance, the discharging needles 37 are disposed such that a positive discharging needle and a negative discharging needle appear alternately in each row and between each adjacent rows as seen in FIG. 16. Alternatively, the discharging needles 37 may be disposed such that a row in which only positive discharging needles are arranged and another row in which only negative discharging needles are arranged appear alternately in the travelling direction of the film 1. It is to be noted that reference numerals 39 and 40 in FIGS. 15 and 16 denote high voltage cables for supplying high positive and negative dc voltages, respectively.

Figure 17:
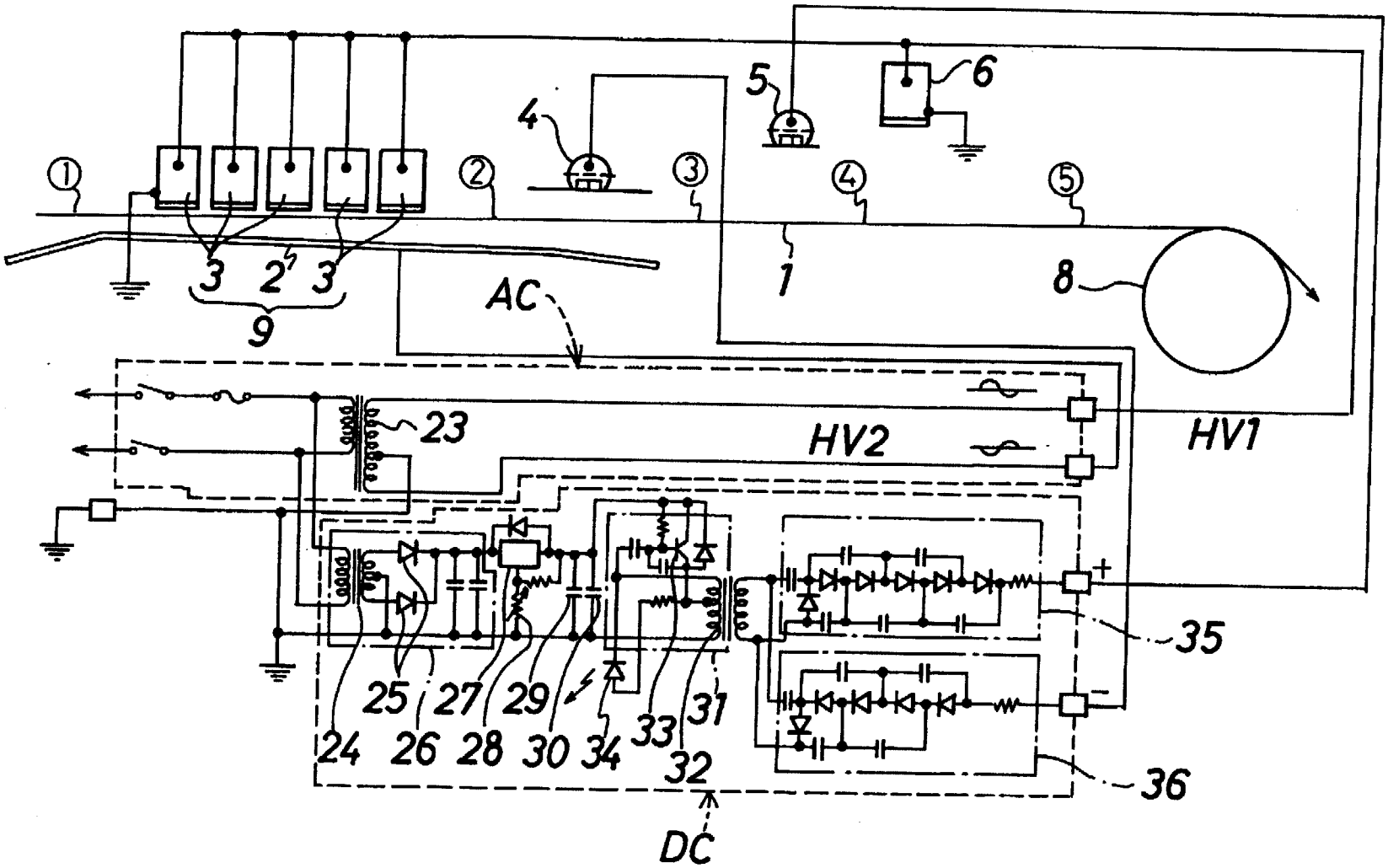
FIG. 17 is an electric wiring diagram principally showing an example of a power source for a discharging station of the discharging and dust removing apparatus of FIG. 1.

A detailed example of a construction of the power source for the discharging station A is shown in FIG. 17. Referring to FIG. 17, the high ac voltage power source AC shown includes a transformer 23 for stepping up an ac voltage from a commercial ac power supply. One of a pair of positive and negative taps of the secondary winding of the transformer 23 is connected to all of the discharging electrodes 3 arranged in such a manner as described hereinabove while the other tap is connected to the ion attracting electrode 2. Accordingly, the high ac voltages HV1 and HV2 of the opposite phases are applied at a time to the discharging electrodes 3 and the ion attracting electrode 2, respectively. The common ion attracting electrode 2 in the form of a plate is inclined, in the arrangement shown in FIG. 17, downwardly toward the travelling direction of the film 1 so that the ion attracting force to the discharging electrodes 3 may gradually decrease as the film 1 travels. Such downwardly inclined arrangement allows efficient elimination of macroscopic discharging unevenness.

A high dc voltage power source apparatus DC converts the ac voltage from the commercial ac power supply into a dropped dc voltage by means of an ac to dc conversion section 26 which includes a transformer 24, a diode 25 and so forth. The dc voltage is supplied to a constant voltage IC circuit 27, and a dc voltage adjusted arbitrarily by a variable resistor 28 is outputted from an output terminal of the constant voltage IC circuit 27. Then, the thus adjusted dc voltage is smoothed by a pair of capacitors 29 and 30 and then applied to a high frequency oscillating circuit 31.

The high frequency oscillating circuit 31 is connected to the primary winding of a high frequency transformer 32. Thus, when the dc voltage is applied to the high frequency oscillating circuit 31, a starting transistor 33 is turned on, and consequently, the high frequency oscillating circuit 31 oscillates a high frequency wave by its self-excited oscillation. As a result of such oscillation, a high ac voltage is obtained from the secondary winding of the high frequency oscillating circuit 31, and a light emitting diode 34 is lit.

A positive side voltage multiplying rectifier 35 and a negative side voltage multiplying rectifier 36 are connected in parallel to each other to the secondary winding of the high frequency transformer 32. The voltage multiplying rectifiers 35 and 36 are each formed from a number of diodes and capacitors connected in series such that they are piled up one on another so that a high dc voltage which is a multiple of the secondary voltage of the high frequency transformer 32 is obtained as well known in the art. The output terminal of the negative side voltage multiplying rectifier 36 is connected to the negative ion producing dc discharger 4 by way of a high tension cable to apply a high negative dc voltage to the negative ion producing dc discharger 4. Meanwhile, the output terminal of the voltage multiplying rectifier 35 is similarly connected to the positive ion producing dc discharger 5 by way of another high tension cable to apply a high positive dc voltage to the positive ion producing dc discharger 5.

It is to be noted that the constant voltage IC circuit 27, variable resistor 28, high frequency oscillating circuit 31, high frequency transformer and light emitting diode 34 may be prepared for each of the voltage multiplying rectifiers 35 and 36.

Further, while, in the high ac voltage power source AC shown in FIG. 17, voltages of the opposite phases are extracted from the two taps of the single secondary winding of the transformer 23, two different secondary windings may otherwise be provided for the transformer 23 so as to extract voltages of the opposite phases separately from each other. Furthermore, the connections between the secondary winding of the transformer 23 and the discharging electrodes 3 and between the secondary winding of the transformer 23 and the ion attracting electrode 2 may each have any one of a resistive coupling and a capacitive coupling.

Figure 18:
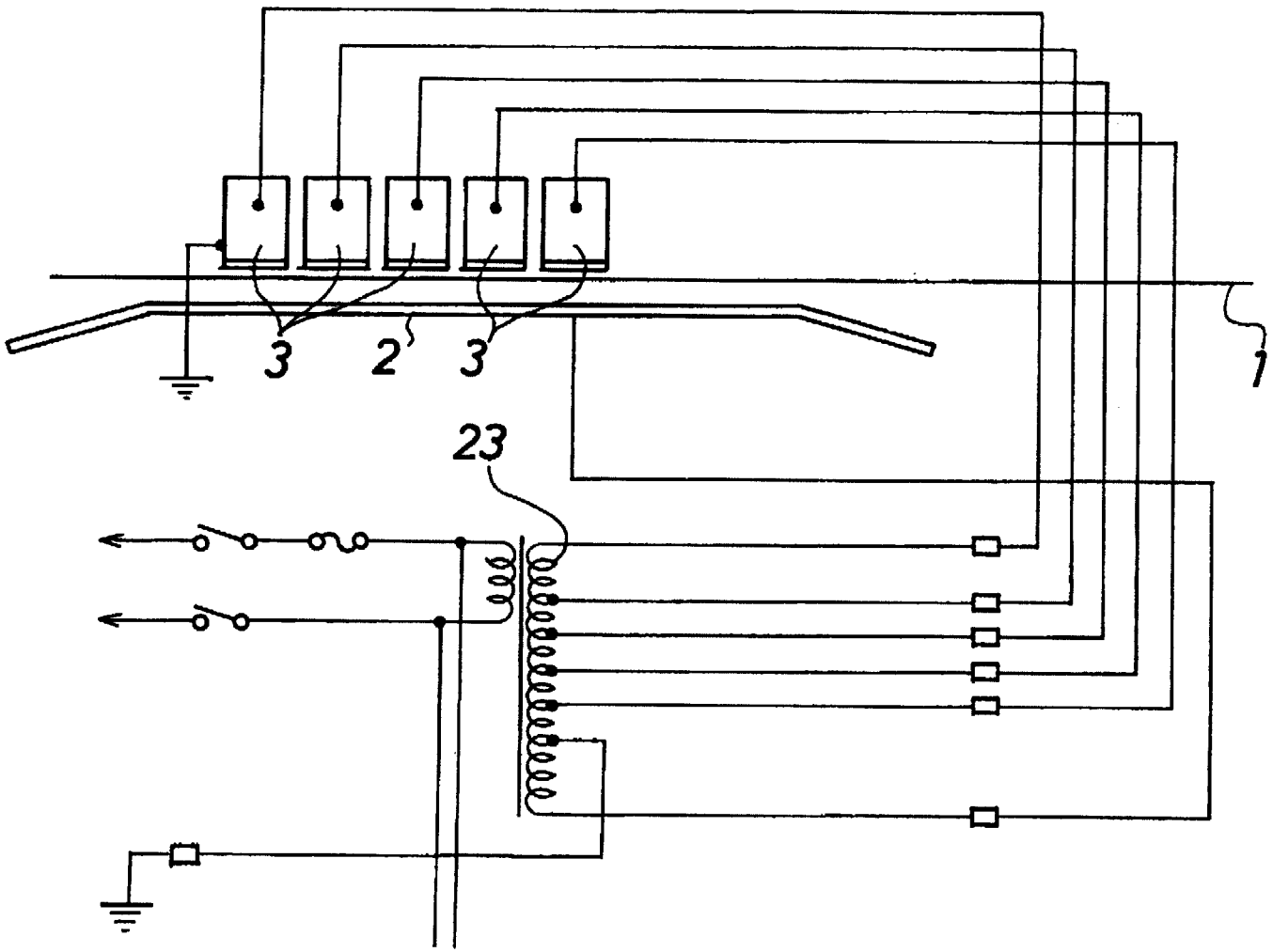
FIGS. 18 to 22 are electric wiring diagrams showing different modifications to the discharging station.

Further, in place of the inclined arrangement of the ion attracting electrode 2 shown in FIG. 17, a plurality of taps may be provided, for example, for the secondary winding of the transformer 23 of the high ac voltage power source AC as shown in FIG. 18 such that the voltages to be applied to the discharging elements 3 may exhibit a successive decrease in the travelling direction of the film 1.

Subsequently, other modifications to the discharging stations than those described above will be described briefly.

Figure 19:
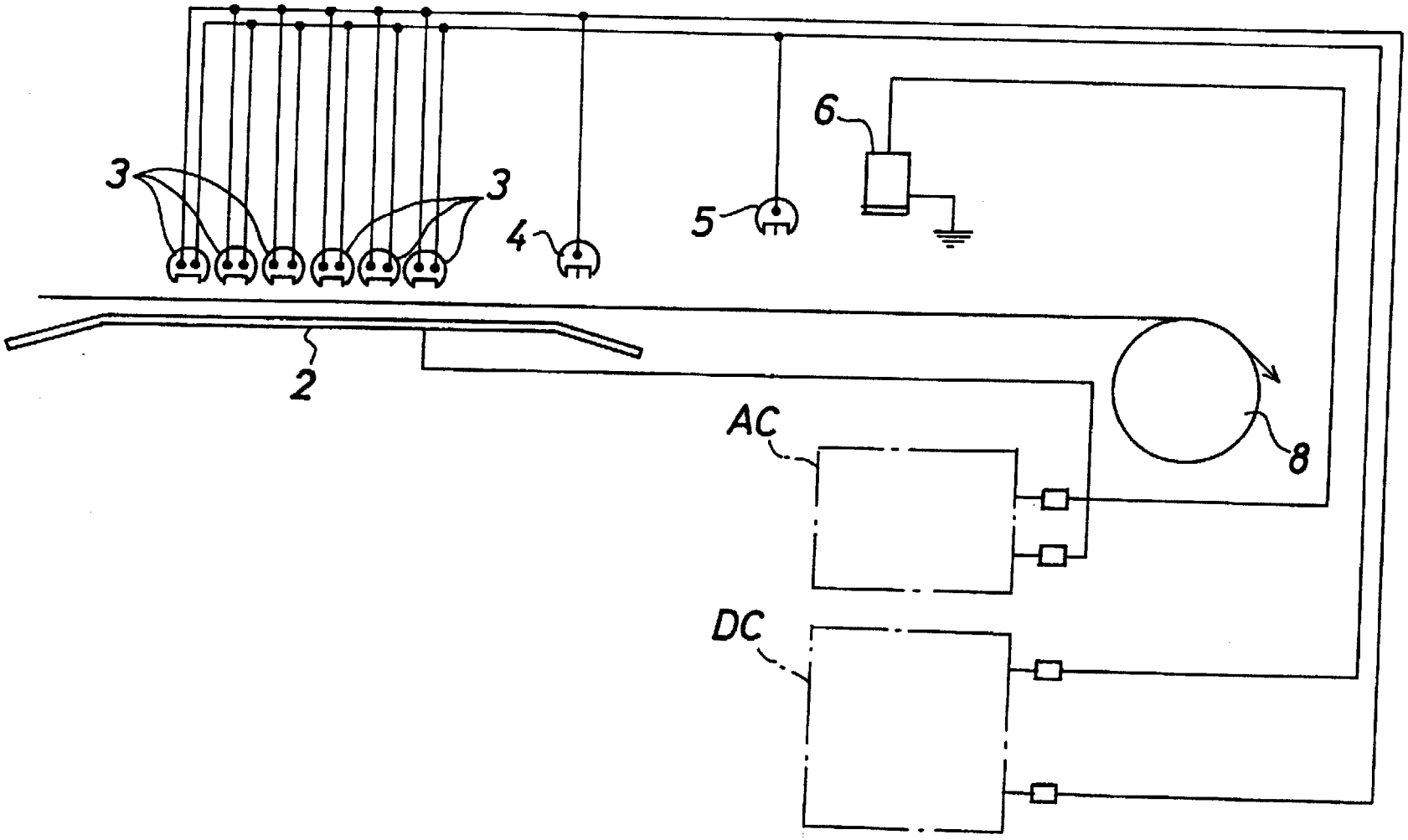

FIG. 19 shows a modified discharging station wherein a dc discharger of the positive and negative ion simultaneous production type is used for each of the discharging electrodes 3 of the discharging gate section 9 and a high positive dc voltage and a high negative dc voltage from the high dc voltage power source apparatus DC are applied at a time to the dc dischargers. In this instance, each of the dc dischargers applies the high positive and negative dc voltages to those discharging needles arranged in a row in the widthwise direction of the film 1 such that they appear alternately in the direction of the arrangement of the discharging needles. In other words, a positive discharging needle and a negative discharging needle appear alternately in each row. Or else, the discharging needles may be divided alternately into rows of positive discharging needles and rows negative discharging needles to which high positive and negative dc voltages are applied separately from each other.

Figure 20:
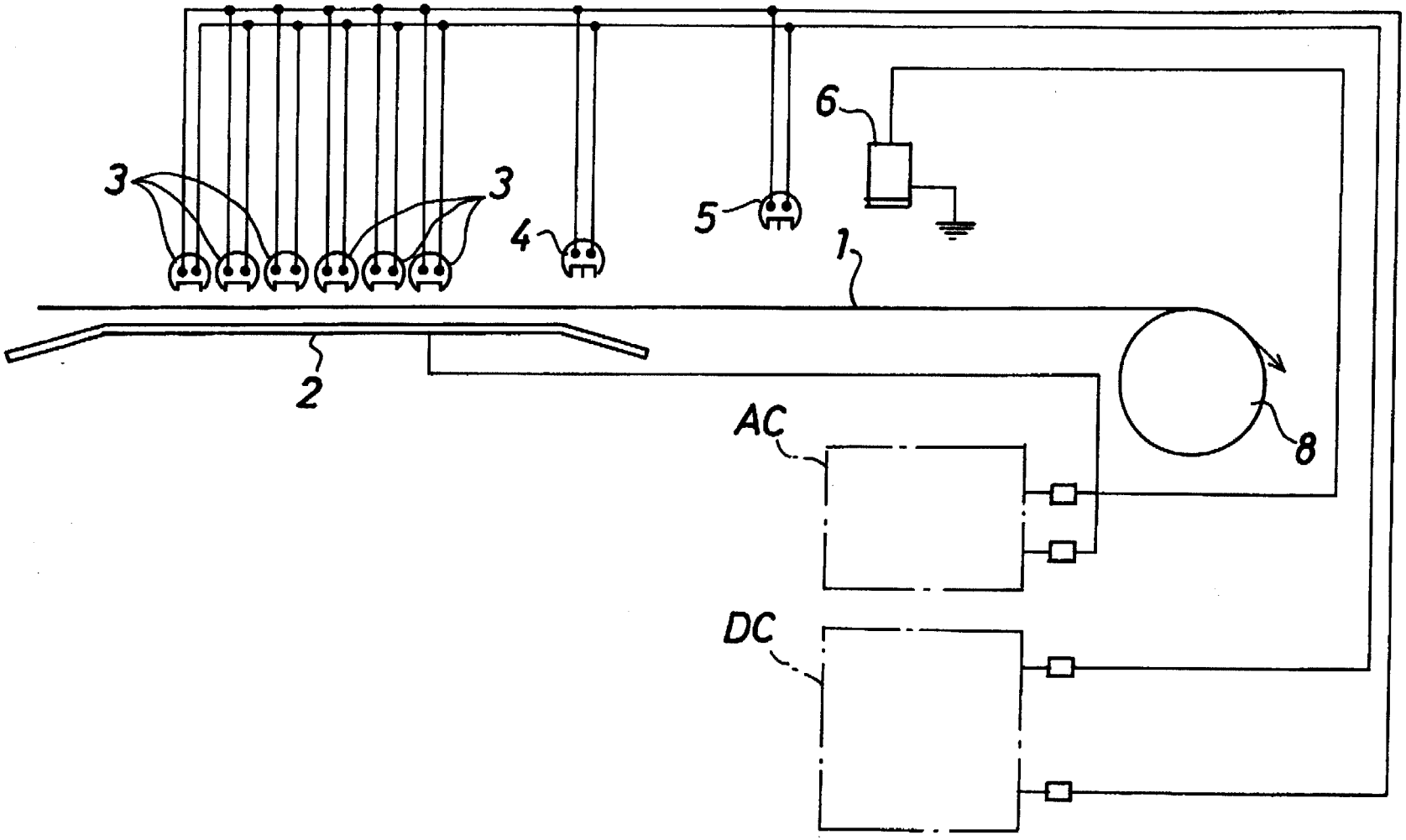
Figure 21:
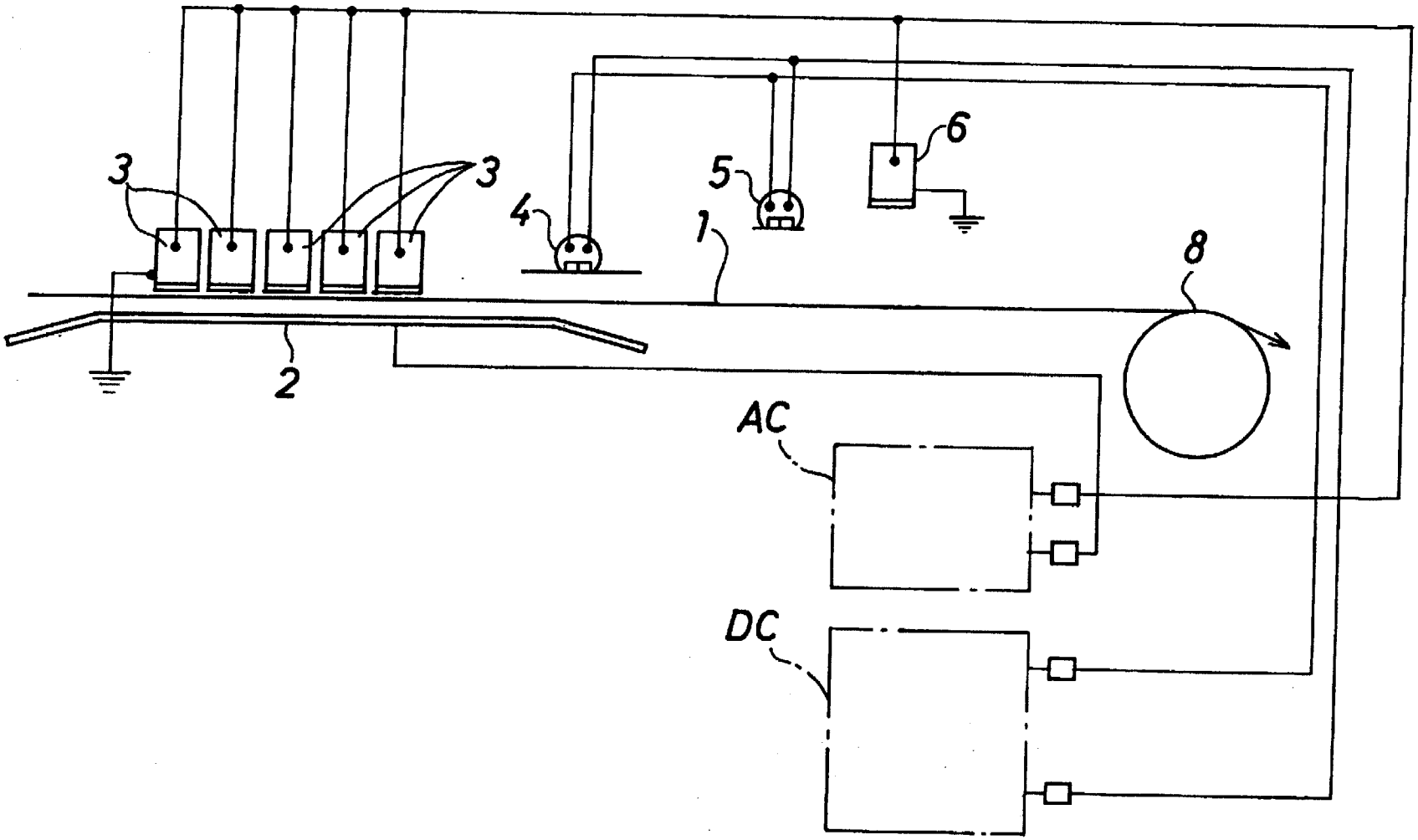

FIG. 20 shows another modified discharging station wherein also the two dc dischargers 4 and 5 disposed between the discharging gate section 9 and the ac discharger 6 are formed from such dc dischargers of the positive and negative ion simultaneous production type as described above. Meanwhile, FIG. 21 shows a further modified discharging station wherein the discharging electrodes 3 of the discharging gate section 9 are formed as discharging electrodes of the ac type while the two dc dischargers 4 and 5 are formed as dc dischargers of the positive and negative ion simultaneous production type. In the arrangements of FIGS. 20 and 21, one of the two dc dischargers 4 and 5 can be omitted.

Figure 22:
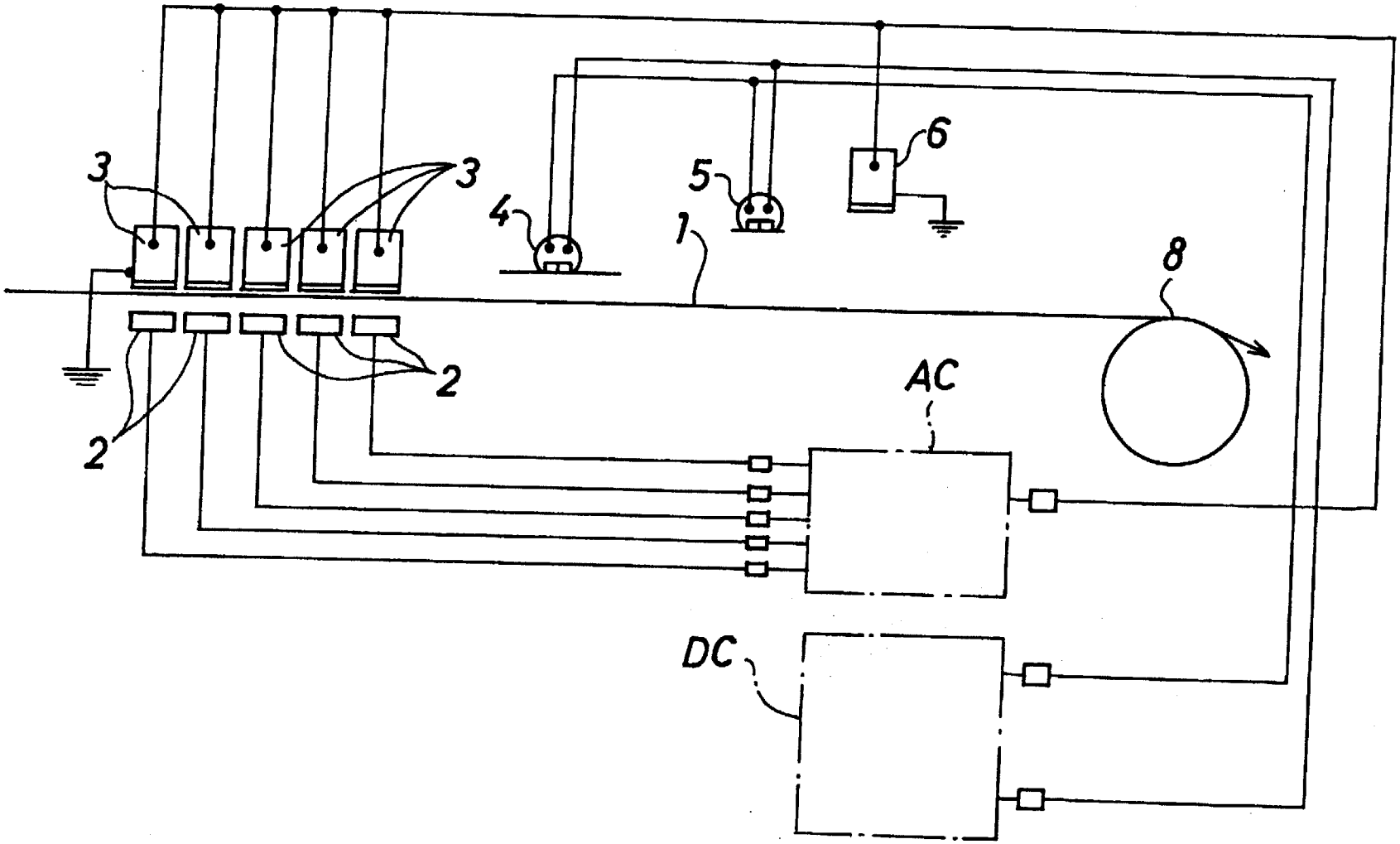

FIG. 22 shows a still further modified discharging station wherein an ion attracting electrode 2 is opposed to each of a plurality of positive and negative ion producing discharging electrodes 3 arranged in parallel in the travelling direction of the film 1 so that positive and negative ions from each of the positive and negative ion producing discharging electrodes 3 are attracted to the corresponding ion attracting electrode 2. In this instance, the high voltages to be applied to the parallel ion attracting electrode 2 are set so as to gradually decrease toward the travelling direction of the film 1.

Where the travelling speed of a working object is low such as in working of a plastic base plate for a liquid crystal display as the working object, a required discharging effect can be achieved even if a single ion attracting electrode 2 is opposed to a single positive and negative ion producing discharging electrode 3.

Figure 23:
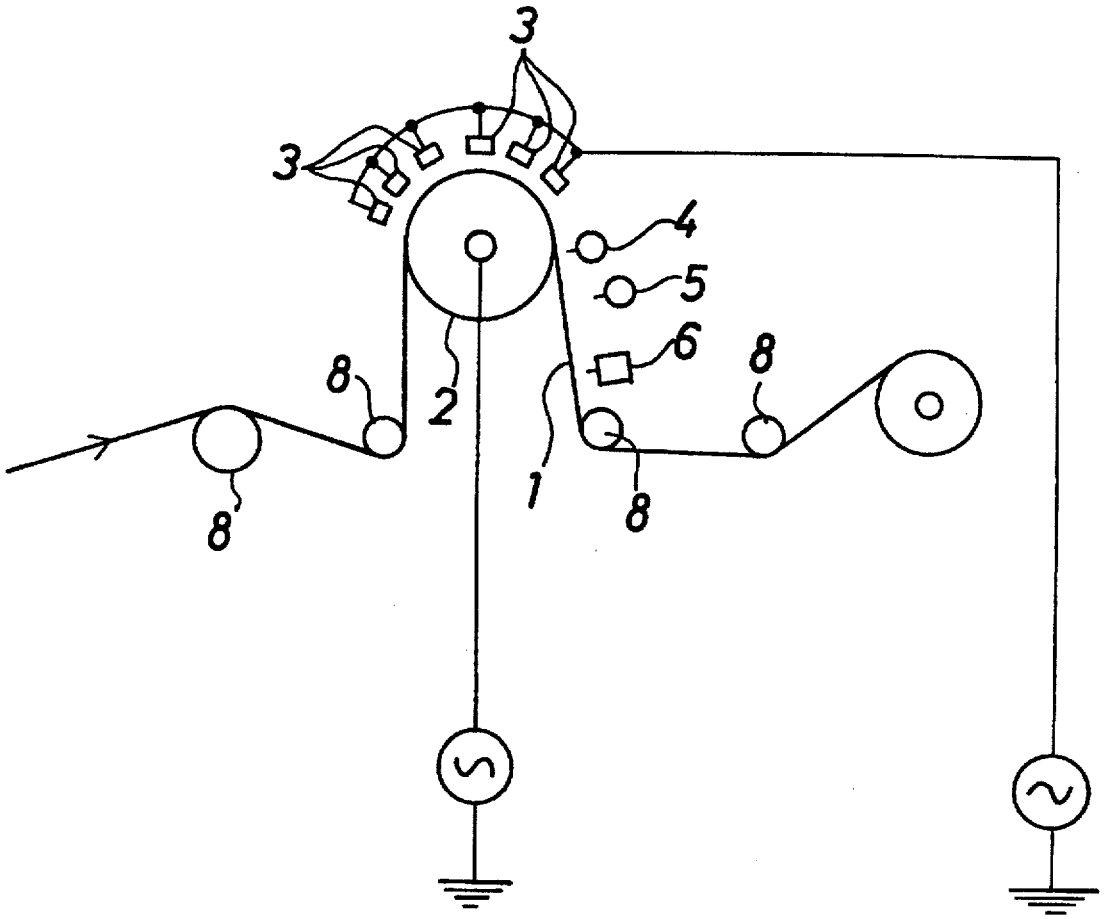
FIG. 23 is a schematic view showing a general construction of an example of the positive and negative ion producing discharging electrode apparatus where a roller for guiding a film is employed for the ion attracting electrode apparatus.
Figure 24:
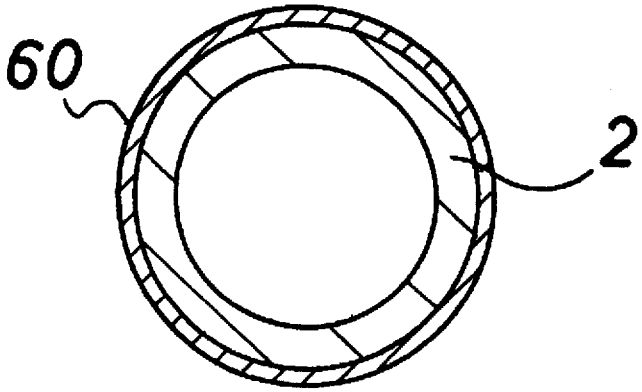
FIG. 24 is an enlarged schematic cross sectional view of the roller shown in FIG. 23.

FIG. 23 is a yet further modified discharging station wherein the ion attracting electrode 2 is formed from a roller for guiding the film 1 and the discharging electrodes 3 are disposed along an arc of the roller. Preferably, the roller is formed from a metal cylindrical member and has a dielectric layer 60 formed on the surface thereof as seen in FIG. 24. Such a structure as shown in FIG. 23 achieves a higher discharging efficiency than that which is achieved where the ion attracting electrode 2 is spaced away from the film 1 as in the other examples described hereinabove. Further, also the size of the apparatus can be reduced.

It is to be noted that an ac discharging electrode or electrodes and a dc discharging electrode or electrodes may be disposed in an opposing relationship to the same ion attracting electrode 2.

Having now fully described the invention, it will be apparent to one of ordinary skill in the art that many changes and modifications can be made thereto without departing from the spirit and scope of the invention as set forth herein.

What is claimed is:

1. A discharging method wherein positive and negative ions are irradiated upon a travelling working object to discharge the working object, comprising the steps of:

passing the working object between a positive and negative ion producing discharging electrode apparatus and an ion attracting electrode apparatus disposed in an opposing relationship to said positive and negative ion producing discharging electrode apparatus;

applying, while the working object passes between said positive and negative ion producing discharging electrode apparatus and said ion attracting electrode apparatus, positive and negative voltages alternately to said positive and negative ion producing discharging electrode apparatus to alternately produce positive and negative ions; and simultaneously applying an ac voltage to said ion attracting electrode apparatus to induce positive and negative potentials in the working object to attract the positive and negative ions produced by said positive and negative ion producing discharging electrode apparatus.

2. A discharging method as claimed in claim 1, wherein ac voltages opposite in phase to each other are applied simultaneously to said positive and negative ion producing discharging electrode apparatus and said ion attracting electrode apparatus.

3. A discharging method as claimed in claim 1, wherein said positive and negative voltages alternately applied to said positive and negative ion producing discharging apparatus is an ac voltage having a lower frequency than said ac voltage applied to said ion attracting electrode apparatus.

4. A discharging method as claimed in claim 1, wherein said positive and negative ion producing discharging electrode apparatus comprises a plurality of positive and negative ion producing discharging electrodes juxtaposed in a travelling direction of the working object while said ion attracting electrode apparatus includes a single ion attracting electrode provided commonly to said positive and negative ion producing discharging electrodes.

5. A discharging method as claimed in claim 4, wherein different voltages are applied to said plurality of positive and ion producing discharging electrodes in such a manner as to successively decrease toward the travelling direction of the working object.

6. A discharging method as claimed in claim 1, wherein said positive and negative ion producing discharging electrode apparatus comprises a plurality of positive and negative ion producing discharging electrodes juxtaposed in a travelling direction of the working object while said ion attracting electrode apparatus includes a plurality of ion attracting electrodes individually corresponding to said positive and negative ion producing discharging electrodes.

7. A discharging method as claimed in claim 6, wherein different voltages are applied to said plurality of ion attracting electrodes in such a manner as to successively decrease toward the travelling direction of the working object.

8. A discharging method as claimed in claim 1, further comprising the step of irradiating positive or negative ions produced by a dc discharger upon the working object after said working object has been irradiated with positive and negative ions from said positive and negative ion producing discharging electrode apparatus, said dc discharger producing a weaker discharging condition than said positive and negative ion producing discharging electrode apparatus.

9. A discharging method as claimed in claim 8, wherein, after positive or negative ions from said dc discharger are irradiated upon the working object, positive and negative ions from an ac discharger are irradiated upon the working object in a weaker discharging condition than that by said dc discharger.

10. A discharging method wherein positive and negative ions are irradiated upon a travelling working object to discharge the working object, comprising the steps of:

passing the working object between a positive and negative ion producing discharging electrode apparatus and an ion attracting electrode apparatus disposed in an opposing relationship to said positive and negative ion producing discharging electrode apparatus, said positive and negative ion producing discharging electrode apparatus including a positive ion producing electrode and a negative ion producing electrode;

applying, while the working object passes between said positive and negative ion producing discharging electrode apparatus and said ion attracting electrode apparatus, a positive voltage to said positive ion producing electrode to produce positive ions and a negative voltage to said negative ion producing electrode to produce negative ions; and simultaneously applying an ac voltage to said ion attracting electrode apparatus to induce positive and negative potentials in the working object to attract the positive and negative ion produced by said positive and negative ion producing discharging electrode apparatus.

11. A discharging and dust removing method wherein positive and negative ions are irradiated upon a travelling working object to discharge the working object and then air is jetted to the working object to remove dust or some other foreign articles from the working object, comprising the steps of:

passing the working object between a positive and negative ion producing discharging electrode apparatus and an ion attracting electrode apparatus disposed in an opposing relationship to said positive and negative ion producing discharging electrode apparatus;

applying; while the working object passes between said positive and negative ion producing discharging electrode apparatus and said ion attracting electrode apparatus, positive and negative voltages alternately to said positive and negative ion producing discharging electrode apparatus to alternatively produce positive and negative ions;

simultaneously applying an ac voltage to said ion attracting electrode apparatus to induce positive and negative potentials in the working object to attract the positive and negative ions produced by said positive and negative ion producing discharging electrode apparatus; and thereafter jetting air to the working object while the working object is travelling to remove dust or some other foreign articles from the working object.

* * * * *